US005381760A

United States Patent [19]

Simonds

[11] Patent Number: 5,381,760

[45] Date of Patent: Jan. 17, 1995

[54] AIR INJECTION SYSTEM FOR INTERNAL COMBUSTION ENGINES DURING COMBUSTION CYCLE OF OPERATION

[75] Inventor: Edward L. Simonds, Adel, Iowa

[73] Assignee: Thermal Dynamics, Inc., Adel, Iowa

[21] Appl. No.: 89,766

[22] Filed: Jul. 9, 1993

[51] Int. Cl.[6] ..... F02B 41/00

[52] U.S. Cl. ..... 123/26

[58] Field of Search ..... 123/26, 308, 432

[56] References Cited

U.S. PATENT DOCUMENTS

| | | | |
|---|---|---|---|
| 1,645,170 | 10/1927 | Whaley | 123/26 |
| 1,799,761 | 4/1931 | Pew | 123/26 |
| 2,011,986 | 8/1934 | Schwarz | 123/26 |
| 2,991,767 | 7/1961 | Candelise | 123/26 |
| 3,397,532 | 8/1968 | Hubers | 123/26 |
| 3,650,261 | 3/1972 | Hutsell | 123/138 |
| 3,735,740 | 5/1973 | Hunt | 123/26 |
| 3,814,065 | 6/1974 | Gospodar | 123/26 |
| 4,217,866 | 8/1980 | Nakajima | 123/432 |
| 4,240,381 | 12/1980 | Lowther | 123/26 |
| 4,446,821 | 5/1984 | Cataldo | 123/26 |
| 4,846,114 | 7/1989 | List | 123/26 |

*Primary Examiner*—Noah P. Kamen

*Attorney, Agent, or Firm*—Zarley, McKee, Thomte, Voorhees, & Sease

[57] ABSTRACT

High pressure air on the order of 3,000 PSI is injected into the combustion chamber of an internal combustion engine during only the combustion cycle of engine operation to increase its horsepower and torque. The injection of air is triggered by the combustion chamber pressure reaching a predetermined level which causes a check valve to be opened thereby providing communication from an air source to the combustion chamber. When the combustion chamber pressure drops to a predetermined level, spring biased pressure combined with air injection pressure will exceed combustion pressure and cause the ball valve to return to its closed position. The cycle will be repeated during each combustion cycle of operation of a multiple cycle engine.

10 Claims, 2 Drawing Sheets

AIR INJECTION SYSTEM FOR INTERNAL COMBUSTION ENGINES DURING COMBUSTION CYCLE OF OPERATION

BACKGROUND OF THE INVENTION

There are times when additional horsepower and torque are desired for vehicle engines such as during drag racing.

Air injection systems are known but have not been used for purposes of increasing horsepower and torque of an internal combustion engine. It is the object of this invention to utilize an air injection system that under the right conditions will increase horsepower and torque of the engine.

SUMMARY OF THE INVENTION

High pressure air on the order of 3,000 PSI is stored on the vehicle and is selectively injected into the combustion chamber during the combustion cycle of a four cycle internal combustion engine. A first check valve is provided in a passageway connecting the high pressure air source to the combustion chamber. A second check valve prevents combustion gasses from reaching the air source container. A shaft having a flat surface engages the first ball valve and unseats it when the shaft is rotated by an arm moved by pressure from the combustion chamber upon reaching a predetermined level sufficient to overcome the spring bias on the arm normally maintaining it in an inoperative position. When the combustion chamber pressure drops to a predetermined lower level, the spring bias on the arm will allow the first ball valve to return to its seated closed position.

The air injection system of this invention involves air being injected at the point of combustion (which conventionally is always before top dead center) and through the power stroke thus increasing horsepower and torque without interference to burning gasses in the combustion chamber. Ambient air is injected under pressure into the air fuel mixture in a burning state. The great difference of temperature between the two masses allows the state of stratification to exist for a brief moment while air-fuel completes its burn. The injected air is absorbing heat from the burning mixture, thus increasing pressure and volume, which in turn increases crank shaft output.

The air is injected through the spark plug port or an adjacent port by means of an adapter. Incorporated into the adapter is a check valve to prevent back flow from the engine. This second valve prevents the flow of air fuel mixture into the transfer tube and thus to the high pressure air source. The transfer tube is attached to a metering first valve which incorporates a ball check valve. The ball check valve checks the flow of high pressure air into the cylinder, until the correct moment when said valve is unseated.

At the correct time, as discussed, the first ball valve is unseated allowing air to be injected into the combustion chamber. The unseating of the first ball valve may be through operation of the shaft being rotated and the flat surface engaging the ball for displacing it or a solenoid could be used by connecting it to a push rod for engagement with the ball valve and controlling its operation by a microprocessor which would receive information from one or all of the spark plug wires, depending on whether or not the processor has a loop circuit.

The loop circuit would keep the firing order in the correct sequence. In addition the processor would be capable of delaying the pulse to the solenoid and holding the pulse width for a longer period of time. This would result in greater or lesser amounts of air being injected according to the desired effect.

The high pressure air is supplied by a storage bottle and/or compressor for continual operation. The high pressure bottle is used by itself for short duration. The air pressure must be greater than the combustion pressure, otherwise the effect is neutralized.

The duration of time during which air is injected into the combustion chamber will vary from 20 milliseconds at a 500 RPM idle speed to 4 milliseconds at 4,000 RPM.

DESCRIPTION OF THE PREFERRED EMBODIMENT

Figure 1:
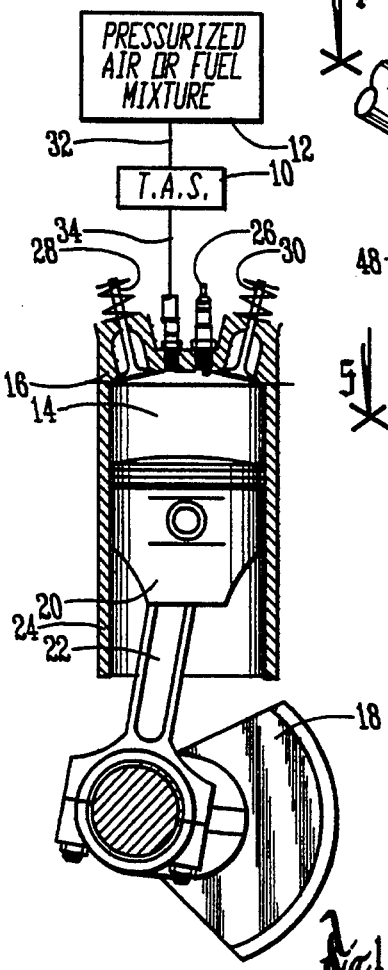
FIG. 1 is a cross sectional view of an engine in a schematic illustration of this invention.
Figure 2:
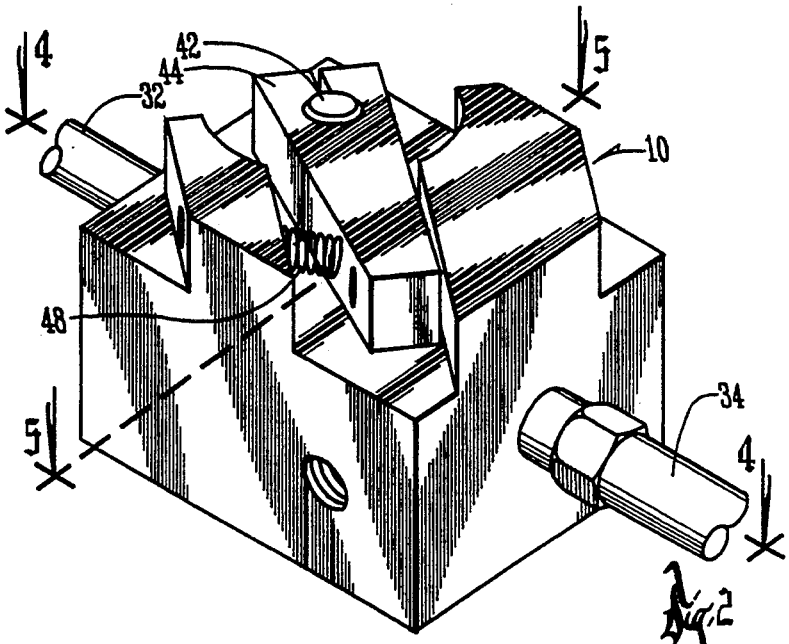
FIG. 2 is a fragmentary perspective view of the torque air valve assembly.
Figure 3:
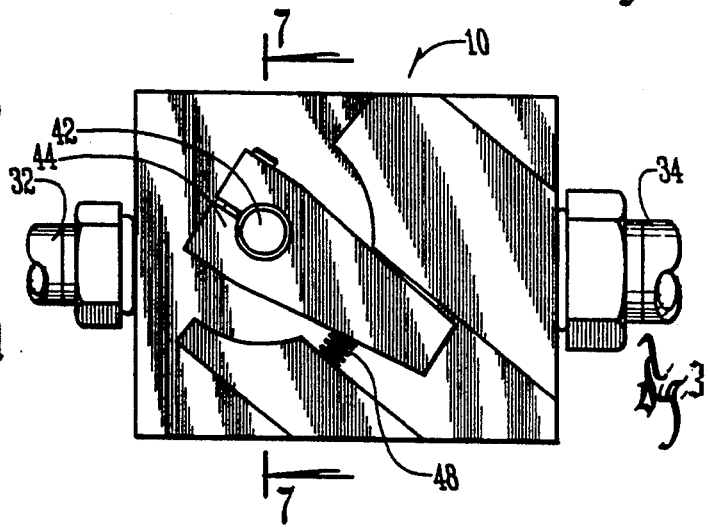
FIG. 3 is a top plan view thereof.
Figure 7:
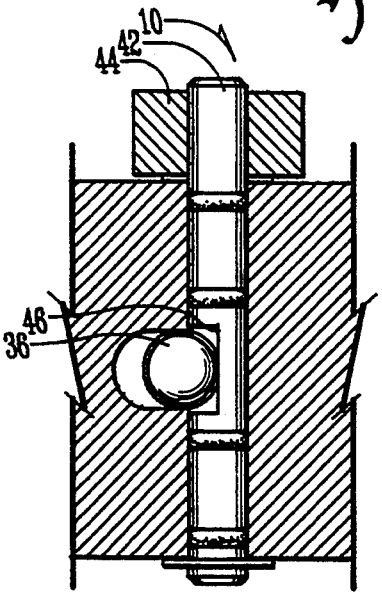
FIG. 7 is a cross sectional view taken along lines 7—7 in FIG. 3 showing the flat surface on a shaft connected to an arm which upon being rotated moves the first ball valve to an unseated open position.

A torque air valve assembly is shown in FIGS. 1 and 2 and referred to generally by the reference numeral 10. The valve assembly is connected between a pressurized air or fuel mixture source 12 and the combustion chamber 14 of an engine 16.

The engine 16 includes a conventional crank shaft 18 connected to a piston 20 by a connecting rod 22 for operation in a cylinder 24. A spark plug 26 is provided along with an intake valve 28 and an exhaust valve 30.

Figure 4:
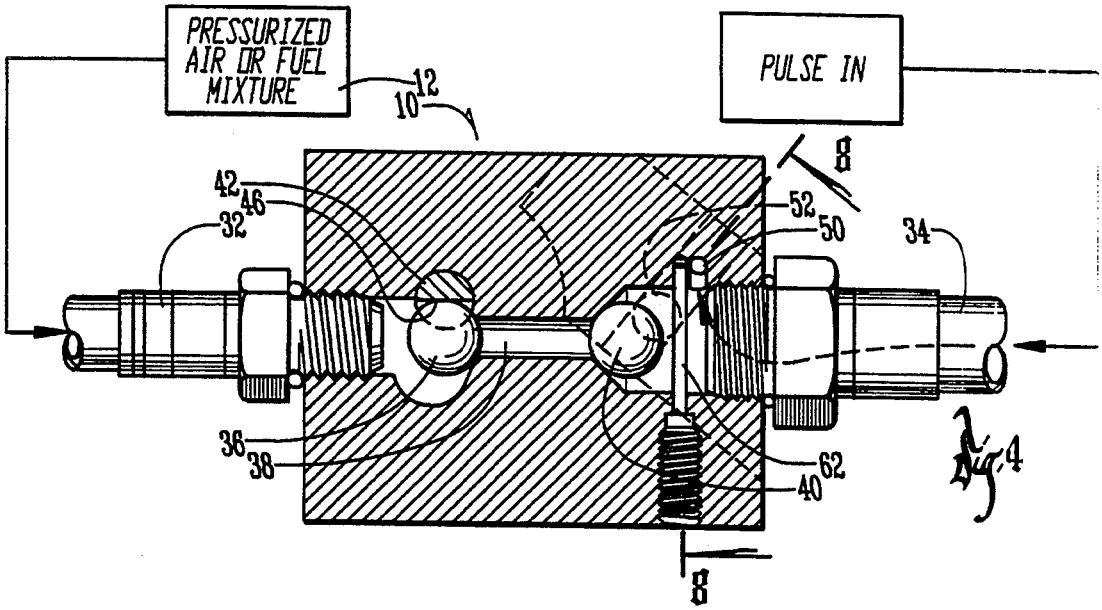
FIG. 4 is a cross sectional view taken along line 4—4 in FIG. 2 showing the first and second valves in their seated closed positions.

The torque air valve assembly 10 includes an air inlet conduit 32 and an outlet conduit 34. As seen in FIG. 4, a first ball check valve 36 is in a closed position at the inlet of a passageway 38 communicating with the outlet conduit 34 through a second ball check valve 40 which limits back flow of combustion chamber gasses.

The ball check valve 36 is moved to an open position by rotation of a shaft 42 which rotates in response to pivotal movement of arm 44. The shaft 42 includes a flat surface 46 which engages the first ball check valve 36 and unseats it.

Figure 8:
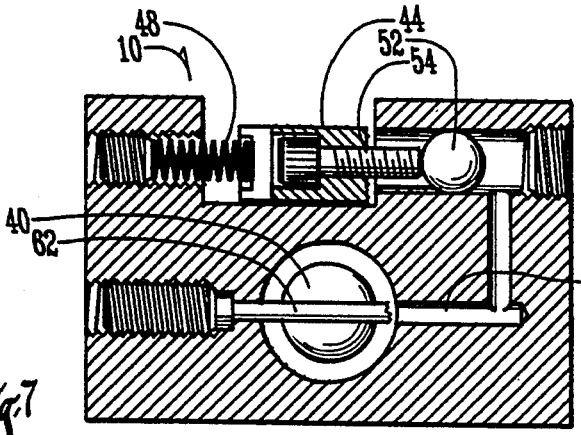
FIG. 8 is a cross sectional view taken along line 8—8 in FIG. 4 showing the passageway from the combustion chamber which allows combustion chamber pressure to pivot an arm against spring resistance to displace the first ball valve.
Figure 5:
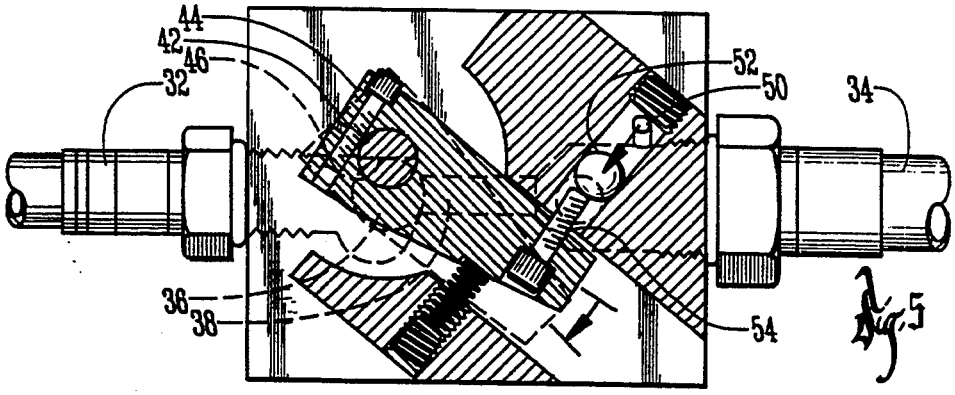
FIG. 5 is a cross sectional view taken along line 5—5 in FIG. 2 showing the first ball valve in its closed position prior to being unseated.
Figure 6:
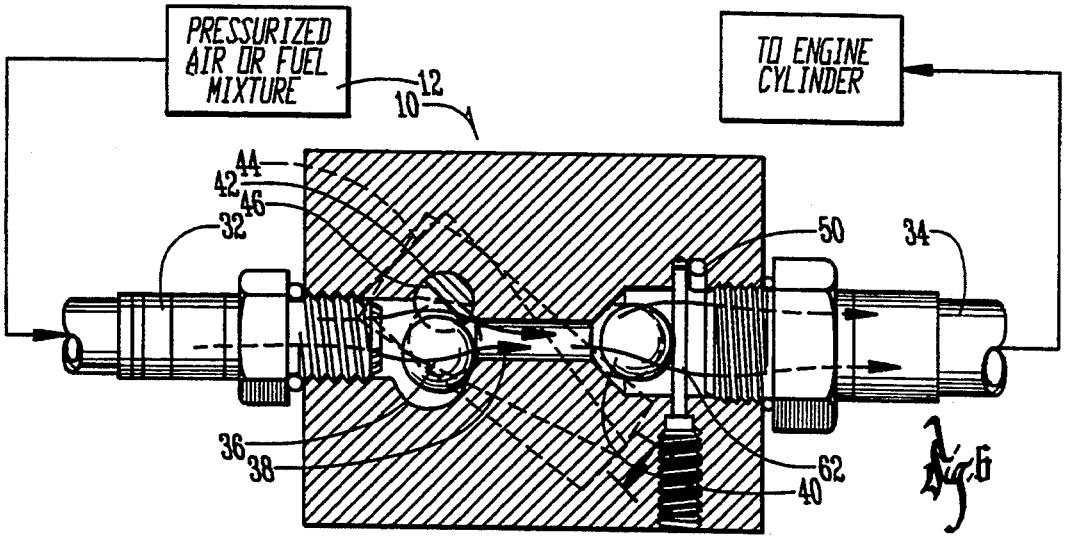
FIG. 6 is a cross sectional view similar to FIG. 5 but showing the first ball valve unseated and thereby placing the air source in communication with the engine combustion chamber.

The arm 44 is biased by a spring 48 to a position allowing the first ball check valve 36 to remain in its seated closed position as seen in FIG. 5. Pressure from the combustion chamber 14 communicates through a passageway 50 as seen in FIG. 8 with a ball 52 engaging an adjustable pin 54 connected to the outer end of pivotal arm 44. Thus when the combustion chamber pressure reaches a level sufficient to move the ball 52 against the pin 54 and overcome the spring pressure 48 the pivotal arm 44 will be pivoted thus unseating the first ball check valve 36 which in turn will allow air to be injected into the combustion chamber 14 through a port 58 adjacent the spark plug 26. Movement of the second back flow check ball valve 40 after being moved to an open position by the air source pressure is limited by a pin stop 62 as seen in FIGS. 4, 6 and 8.

What is claimed is:

1. A method of increasing horsepower and torque of an internal combustion engine comprising the steps of, providing a high pressure air source in communication through a check valve with the engine combustion chamber, providing means for opening said valve upon combustion occurring in said combustion chamber whereby air is injected into said combustion chamber during the combustion cycle of the engine operation, and providing means for closing said check valve when pressure in said combustion chamber drops to a predetermined level.

2. The method of claim 1 wherein said step of providing high pressure air is further defined as providing high pressure ambient temperature air.

3. The method of claim 1 wherein said air injected into said combustion chamber during the combustion cycle is at a pressure on the order of 3000 PSI.

4. The method of claim 1 wherein said air injected into said combustion chamber during the combustion cycle is during a duration of time varying from approximately 20 milliseconds at approximately 500 RPM to approximately 4 milliseconds at 4,000 RPM.

5. The method of claim 1 wherein said air injected into said combustion chamber during the combustion cycle is at a pressure on the order of 3000 PSI and is during a duration of time varying from approximately 20 milliseconds at approximately 500 RPM to approximately 4 milliseconds at approximately 4,000 RPM.

6. An internal combustion engine having a torque air system for increasing horsepower and torque comprising, an engine having a piston operable in a cylinder through multiple cycles including a combustion cycle, a torque air system including a high pressure air source connected through a first valve to said combustion chamber, said first valve being normally maintained in a closed condition by the air pressure from said high pressure air source, valve actuation means for opening said first valve, and control means connected to said actuation means for timing the operation of said first valve such that air is injected into said combustion chamber before top dead center of said combustion cycle of engine operation.

7. The structure of claim 6 wherein said first valve is a check valve and is opened by pressure in said combustion chamber reaching a predetermined level sufficient to trigger operation of said valve actuation means thereby causing said first valve to move to said open position.

8. The structure of claim 7 wherein said control means includes said combustion chamber being in communication with said air source through a second valve which blocks combustion gasses from reaching said air source when said first valve is closed.

9. The structure of claim 8 wherein said control means and actuation means include an arm spring biased to an inoperative position, and combustion pressure being in operative engagement with said arm such that upon it reaching said predetermined level it overcomes said spring bias and moves said arm to open said first valve and upon said combustion pressure dropping below said predetermined pressure said spring moves said arm to its inoperative position allowing said first valve to be closed by pressure from said air source on said first valve.

10. The structure of claim 9 wherein said first valve is a ball valve and said arm includes a shaft positioned closely adjacent to said ball valve and having a flat surface which when said shaft is turned by said arm engages said ball valve and moves it to said open position.

* * * * *